US010550647B2

(12) United States Patent
Tang et al.

(10) Patent No.: US 10,550,647 B2
(45) Date of Patent: Feb. 4, 2020

(54) DOWNHOLE AUTOMATIC CONNECTION DEVICE AND METHOD FOR OIL PIPE INTERNAL COMMUNICATION CABLE USED FOR INTELLIGENT LAYERED WATER INJECTION

(71) Applicant: SOUTHWEST PETROLEUM UNIVERSITY, Chengdu (CN)

(72) Inventors: Yang Tang, Chengdu (CN); Qingyou Liu, Chengdu (CN); Guorong Wang, Chengdu (CN); Wang Li, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 89 days.

(21) Appl. No.: 16/066,060

(22) PCT Filed: Sep. 1, 2017

(86) PCT No.: PCT/CN2017/100155

§ 371 (c)(1),
(2) Date: Jun. 25, 2018

(87) PCT Pub. No.: WO2019/000631

PCT Pub. Date: Jan. 3, 2019

(65) Prior Publication Data

US 2019/0376347 A1 Dec. 12, 2019

(30) Foreign Application Priority Data

Jun. 27, 2017 (CN) ..... 2017 1 0499110

(51) Int. Cl.
*E21B 17/02* (2006.01)
*H01R 13/62* (2006.01)
(Continued)

(52) U.S. Cl.
CPC ..... *E21B 17/023* (2013.01); *H01R 13/6205* (2013.01); *H01R 13/631* (2013.01); *H01R 43/26* (2013.01)

(58) Field of Classification Search
CPC . E21B 17/023; H01R 13/6205; H01R 13/631; H01R 43/26
See application file for complete search history.

(56) References Cited

U.S. PATENT DOCUMENTS 9,695,646 B2 * 7/2017 Grice ..... E21B 17/028

FOREIGN PATENT DOCUMENTS

CN 201292826 Y 8/2009
CN 103075136 A 5/2013
(Continued)

*Primary Examiner* — Matthew R Buck
(74) *Attorney, Agent, or Firm* — Gokalp Bayramoglu

(57) ABSTRACT

The present invention discloses a downhole automatic connection device for an oil pipe internal communication cable for intelligent layered water injection. The connection device comprises a water injection pipe string in which a cable lowering mechanism is arranged. The cable lowering mechanism comprises a cable, a cable female connector, a motor and load-bearing blades. The cable female connector comprises a female connector shell, a jack insulating plate and an electromagnet. A cable male connector is also fixedly arranged in the water injection pipe string. The cable male connector comprises a male connector shell, a pin insulating plate and an NdFeB magnet. A pin wire welding point is electrically connected with a sensor on an intelligent water distributor. A lead arranged in the pin insulating plate is connected between a pin and the pin wire welding point. The present invention also discloses a connection method.

14 Claims, 8 Drawing Sheets

(51) Int. Cl.
*H01R 43/26* (2006.01)
*H01R 13/631* (2006.01)

(56) References Cited

FOREIGN PATENT DOCUMENTS

| | | | |
|---|---|---|---|
| CN | 103244098 | A | 8/2013 |
| CN | 106837227 | A | 6/2017 |
| CN | 206220877 | U | 6/2017 |
| CN | 206271959 | U | 6/2017 |

* cited by examiner

DOWNHOLE AUTOMATIC CONNECTION DEVICE AND METHOD FOR OIL PIPE INTERNAL COMMUNICATION CABLE USED FOR INTELLIGENT LAYERED WATER INJECTION

CROSS REFERENCE TO RELATED APPLICATIONS

This application is the national phase entry of International Application No. PCT/CN2017/100155, filed on Sep. 1, 2017, which is based upon and claims priority to Chinese Patent Application No. 201710499110.0 filed on Jun. 27, 2017, the entire contents of which are incorporated herein by reference.

TECHNICAL FIELD

The present invention relates to the technical field of oil exploitation, and in particular, to a downhole automatic connection device and method for an oil pipe internal communication cable used for intelligent layered water injection.

BACKGROUND

At present, with the gradual deepening of water injection development of oil and gas fields, separate layer water injection construction of a water injection well is becoming more frequent. The separate layer water injection means that a packer is lowered into the water injection well to separate oil reservoirs that differ greatly, and then an intelligent water distributor is used for separate layer water distribution, such that the water injection rate of a high permeability layer is controlled, while the water injection rate of medium and low permeability oil reservoirs is increased, and ultimately it is ensured that the effects of various oil reservoirs are exerted. The water injection rate, pressure, etc. of each water injection layer is hardly monitored and controlled on the ground in real time during the separate layer water injection.

In order to solve the above problems, it is possible to mount a male connector in an oil and gas well, and mount a female connector at the head of a cable. During working, the cable is lowered first to a certain depth, and then the female connector and the male connector are docked, such that ground monitoring and control equipment is electrically connected with a pressure sensor, a flow sensor and a temperature sensor on a water distributor, i.e., the collected pressure and flow information is transmitted to the ground equipment via the cable. However, the cable has a low lowering speed and low connection efficiency, and the oil and gas well is too deep to ensure accurate docking between the male connector and the female connector. The male connector and the female connector cannot be connected steadily under a water pressure during the water injection even if they are connected. Therefore, there is an urgent need for a set of device that can realize ground and downhole real-time communication, detect and control the downhole water injection rate, pressure, etc., in each layer, and ensure that the male connector and the male connector are connected firmly.

SUMMARY

Technical Problem

In order to realize real-time communication between ground and downhole, the present invention provides a downhole automatic connection device and method for an oil pipe internal communication cable used for intelligent layered water injection. The device has a compact structure and high connection efficiency, is simple to operate, ensures that male and female connectors are connected steadily, and prevents downhole short circuit and wet plug.

Technical Solution

The objective of the present invention is realized by means of the following technical solution: a downhole automatic connection device for an oil pipe internal communication cable for intelligent layered water injection comprises a water injection pipe string, a hydraulic anchor, a cable-through packer, an intelligent water distributor, a hydraulic support anchor and a plug which are sequentially connected to the lower end of the water injection pipe string, wherein a cable lowering mechanism is arranged in the water injection pipe string; the cable lowering mechanism comprises a cable, a cable female connector, a motor and load-bearing blades; the tail end of the cable is sleeved with a housing; a plurality of load-bearing blades is uniformly hinged on a cylindrical surface of the housing in a circumferential direction of the cylindrical surface; a roller is rotatably mounted at the other end of each of the load-bearing blades; each roller is tangential to the inner wall of the water injection pipe string; a through groove which is positioned above the load-bearing blades is arranged on each of two sides of the housing; the housing is sleeved with a left semicircular member and a right semicircular member which are fixedly connected; a connecting rod is hinged on the semicircular members; the other end of the connecting rod is hinged on the load-bearing blades; a connecting rod which penetrates through the corresponding through groove is arranged on the left semicircular member and the right semicircular member respectively; a nut is fixed between the two connecting rods; the motor is fixedly arranged in the housing; a screw rod is connected to an output shaft of the motor and is in threaded connection with the nut; the cable female connector comprises a female connector shell, a jack insulating plate and an electromagnet; the female connector shell is fixedly arranged at the bottom of the housing and communicated with the housing; the electromagnet is arranged at the bottom of the jack insulating plate; the jack insulating plate is fixedly arranged on the female connector shell; an annular groove is arranged between the jack insulating plate and the inner wall of the female connector shell; the bottom surface of the female connector shell is a guide surface inclined to the left; a right cylindrical surface of the female connector shell is provided with a guide groove; the jack insulating plate is internally provided with a jack that is arranged vertically; a jack wire welding point is fixedly arranged on the top of the jack; a conductive sleeve is arranged in the jack and is fixedly connected with one end of the jack wire welding point; the other end of the jack wire welding point is connected with the cable;

a cable male connector is also fixedly arranged in the water injection pipe string; the cable male connector comprises a male connector shell, a pin insulating plate and an NdFeB magnet; the pin insulating plate is fixedly arranged in the male connector shell; the NdFeB magnet is arranged on the top of the pin insulating plate; a tapered surface matched with the guide surface is arranged in the middle of the male connector shell; a right cylindrical surface of the pin insulating plate is provided with a guide bolt matched with the guide groove; a pin and a pin wire welding point are arranged on the top and the bottom of the pin insulating plate respectively; the pin wire welding point is electrically connected with a sensor on the intelligent water distributor; a lead which is positioned in the pin insulating plate is connected between the pin and the pin wire welding point.

A sealing ring I is arranged on the top of the male connector shell.

A snap spring is fixedly arranged in the male connector shell.

The pin insulating plate is fixedly arranged on the snap spring.

A cylindrical surface of the jack insulating plate is provided with a sealing ring II.

A communication cable, a control cable and a power cable are arranged in the cable.

The NdFeB magnet is a permanent magnet.

A downhole automatic connection method for an oil pipe internal communication cable for intelligent layered water injection by using the device comprises the following steps:

S1, lowering the water injection pipe string into an oil and gas well; lowering the cable of the cable lowering mechanism into the water injection pipe string, such that all the rollers are in contact with the inner wall of the water injection pipe string respectively; then, injecting water to the water injection pipe string, wherein water flow provides power for downward movement of the cable lowering mechanism, that is, after the load-bearing blades (10) are impacted by water, the rollers (12) move downwards along the water injection pipe string;

S2, when the cable is lowered to a predetermined depth, i.e., the cable female connector is about to touch the cable male connector, electrifying the electromagnet, wherein the cable female connector and the cable male connector attract with each other, the upper end of the male connector shell is plugged into the annular groove of the female connector shell, and the guide surface on the bottom surface of the female connector shell and the tapered surface in the middle of the male connector shell then gradually match to ensure the connection directionality; after the guide surface completely matches the tapered surface, the guide bolt is exactly plugged into the guide groove, and the pin is plugged into the conductive sleeve, such that the docking between the cable female connector and the cable male connector is realized;

S3, at the end of the step S2, controlling the motor to rotate forward, wherein the motor drives the screw rod to rotate, and the nut moves upwards along the screw rod, such that a lantern ring moves upwards; the connecting rod drives the load-bearing blades to rotate around a hinge point between the load-bearing blades and the housing to converge the load-bearing blades; and S4, detecting a water injection flow rate, a water injection pressure and a temperature by a flow sensor, a pressure sensor and a temperature sensor on the intelligent water distributor respectively, and converting these parameters into electric signals, wherein the electric signals are finally transmitted to ground monitoring or control equipment via the pin wire welding point, the lead, the pin, the conductive sleeve, the jack wire welding point and the cable in sequence, thereby realizing ground and downhole real-time communication, and further realizing the control over the water injection pressure and the water injection flow rate.

Beneficial Effects

The present invention has the following advantages: the male and female connectors are connected steadily, and downhole short circuit and wet plug can be prevented so that the connection efficiency is high and operation is easy; and ground and downhole real-time communication can be realized.

In drawings, reference signs represent the following components: 1—water injection water string; 2—hydraulic anchor; 3—cable-through packer; 4—intelligent water distributor; 5—hydraulic support anchor; 6—plug; 7—cable; 8—cable female connector; 9—motor; 10—load-bearing blades; 11—housing; 12—roller; 13—through groove; 14—left semicircular member; 15—right semicircular member; 16—connecting rod; 17—connecting rod; 18—nut; 19—screw rod; 20—female connector shell; 21—jack insulating plate; 22—electromagnet; 23—annular groove; 24—guide surface; 25—guide groove; 26—jack; 27—jack wire welding point; 28—conducive sleeve; 29—cable male connector; 30—male connector shell; 31—pin insulating plate; 32—NdFeB electrode; 33—tapered surface; 34—guide bolt; 35—pin; 36—pin wire welding point; 37—lead; 38—sealing ring I; 39—snap spring; 40—sealing ring II; 41—flow sensor; 42—pressure sensor and 43—temperature sensor.

DETAILED DESCRIPTION

Figure 1:
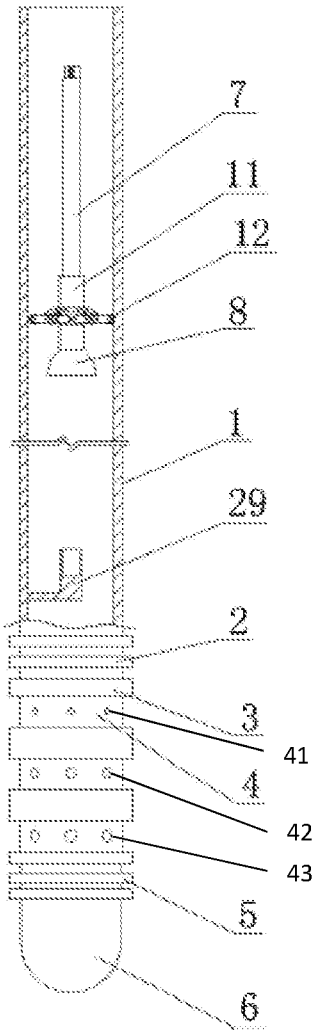
FIG. 1 is a schematic structural drawing of the present invention.
Figure 2:
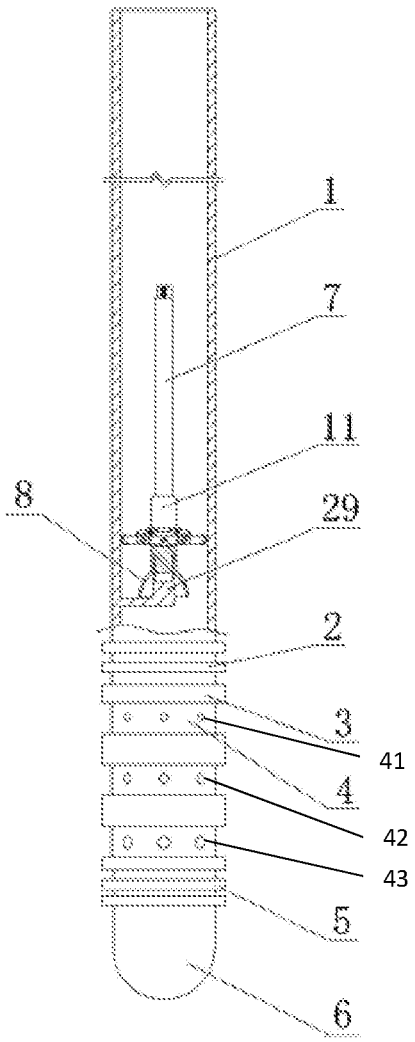
FIG. 2 is a schematic structural drawing when a cable male connector and a cable female connector are docked.
Figure 3:
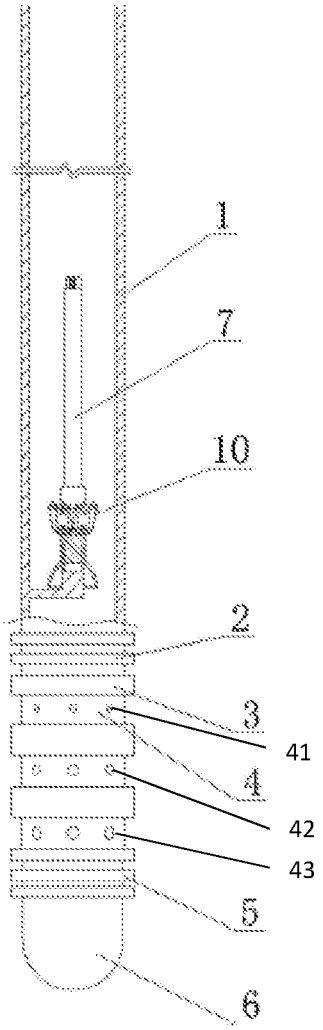
FIG. 3 is a schematic structural drawing of a converged state of load-bearing blades.
Figure 4:
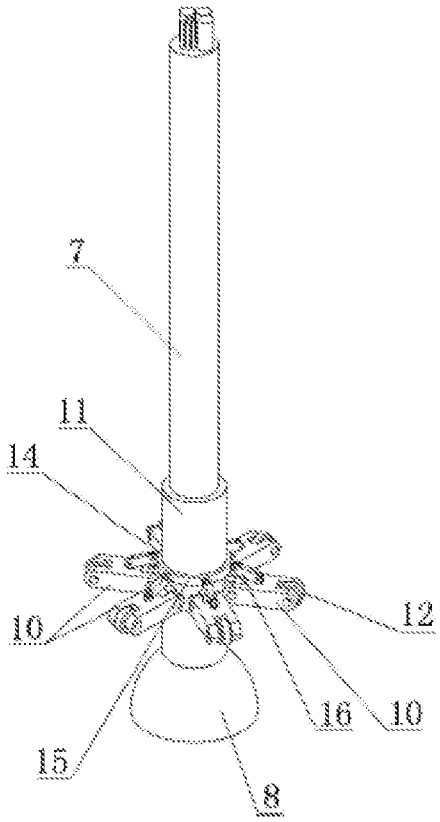
FIG. 4 is a schematic structural drawing of a cable lowering mechanism.
Figure 5:
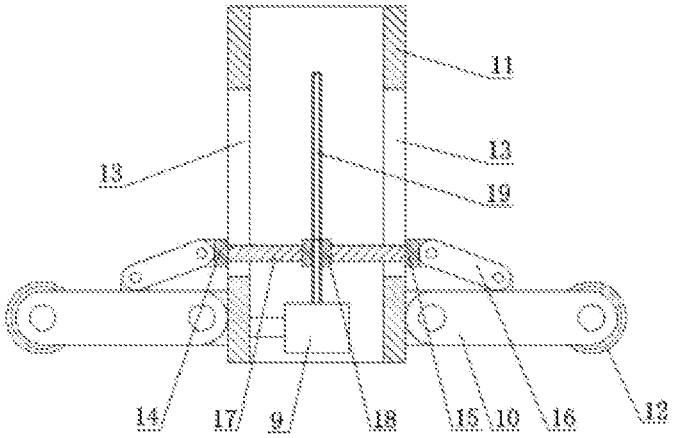
FIG. 5 is a schematic mounting drawing of a housing, semicircular members and load-bearing blades in the cable lowering mechanism.

The present invention will be further described below with reference to the accompanying drawings. The scope of protection of the present invention is not limited to the followings:

As shown in FIGS. 1 to 5, a downhole automatic connection device for an oil pipe internal communication cable for intelligent layered water injection comprises a water injection pipe string 1, and a hydraulic anchor 2, a cable-through packer 3, an intelligent water distributor 4, a hydraulic support anchor and a plug 6 which are sequentially connected to the lower end of the water injection pipe string 1, wherein a cable lowering mechanism is arranged is arranged in the water injection pipe string 1; the cable lowering mechanism comprises a cable 7, a cable female connector 8, a motor 9 and load-bearing blades 10; a communication cable, a control cable and a power cable are arranged in the cable 7; the cable 7 is connected with ground monitoring and control equipment; the tail end of the cable 7 is sleeved with a housing 11; a plurality of load-bearing blades 10 is uniformly hinged on a cylindrical surface of the housing 11 in a circumferential direction of the cylindrical surface; a roller 12 is rotatably mounted at the other end of each of the load-bearing blades 10; each roller 12 is tangential to the inner wall of the water injection pipe string 1; a through groove 13 which is positioned above the load-bearing blades 10 is arranged on each of two sides of the housing 11; the housing 11 is sleeved with a left semicircular member 14 and a right semicircular member 15 which are fixedly connected and form a lantern ring; the lantern ring may moves upwards and downwards along the housing 11; a connecting rod 16 is hinged on the semicircular members; the other end of the connecting rod 16 is hinged on the load-bearing blades 10; a connecting rod 17 which penetrates through the corresponding through groove 13 is fixedly arranged on the left semicircular member 14 and the right semicircular member 15 respectively; a nut 18 is fixed between the two connecting rods 17; the motor 9 is fixedly arranged in the housing 11; a screw rod 19 is connected to an output shaft of the motor 9 and is in threaded connection with the nut 18. When the motor 9 rotates forwards, the motor 9 drives the screw rod 19 to rotate, and the nut 18 moves downwards along the screw rod 19, such that the lantern ring moves downwards; the connecting rod 16 drives the load-bearing blades 10 to rotate around a hinge point between the load-bearing blades 10 and the housing 11, and the load-bearing blades 10 at this moment are in a converged state for a purpose of providing a larger water through area for water injection and reducing the load-bearing at the same time.

Figure 6:
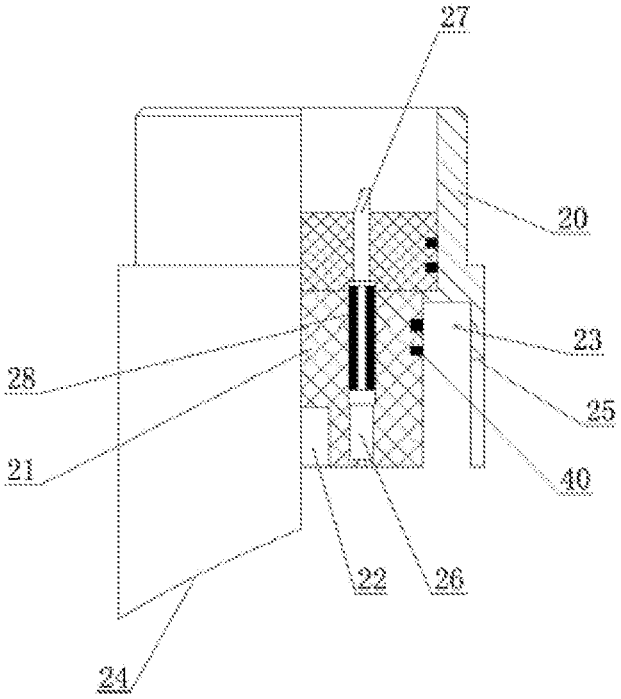
FIG. 6 is a schematic structural drawing of the cable female connector.
Figure 7:
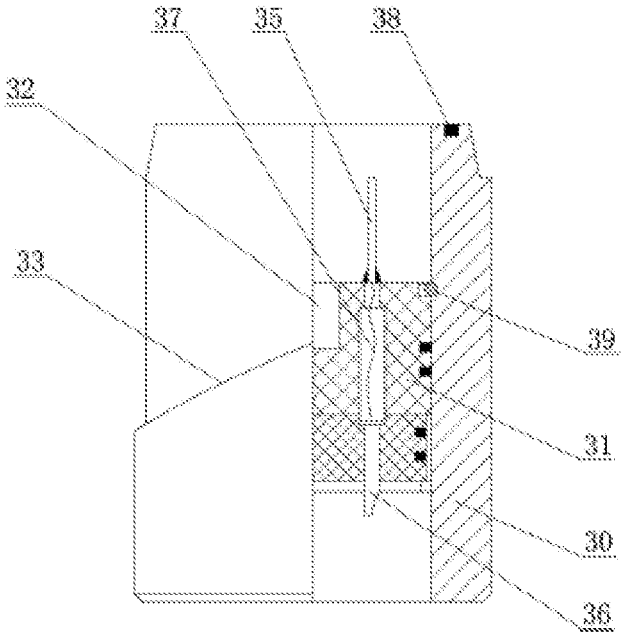
FIG. 7 is a schematic structural drawing of the cable male connector.
Figure 8:
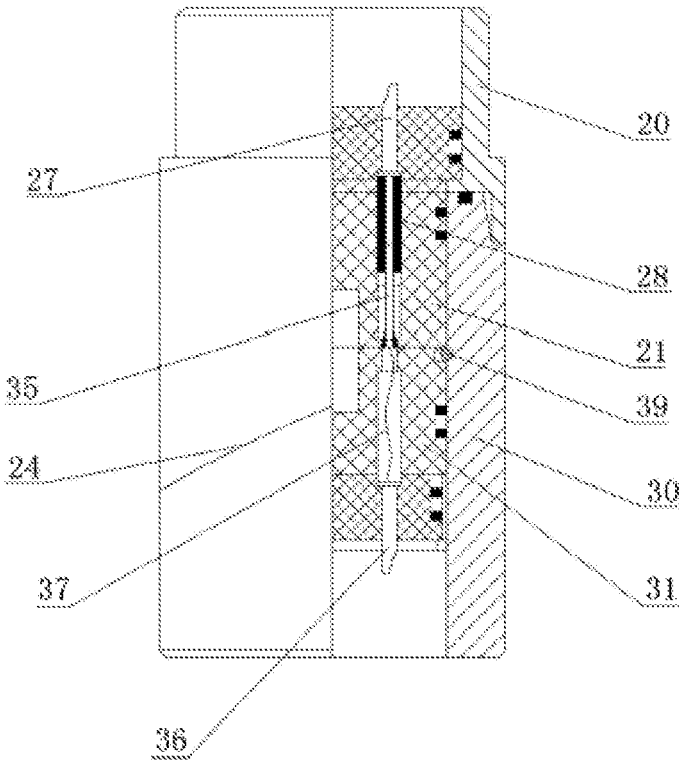
FIG. 8 is a half-sectional view after the cable male connector and the cable female connector are connected.
Figure 9:
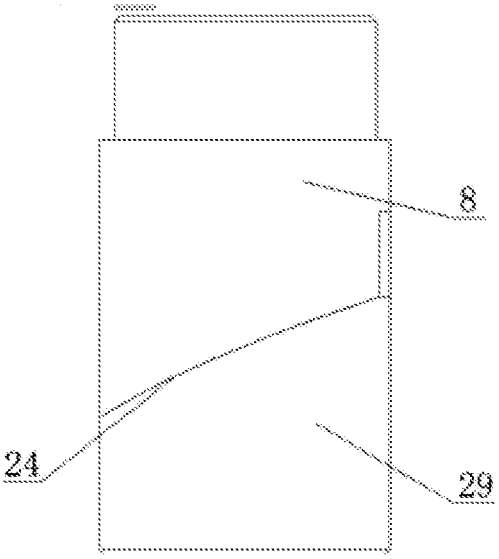
FIG. 9 is a front view of FIG. 8.
Figure 10:
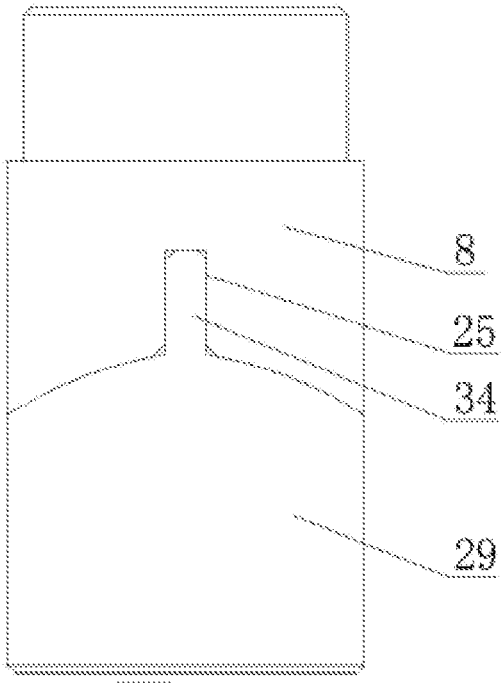
FIG. 10 is a right-side view of FIG. 9.

As shown in FIGS. 6 to 10, the cable female connector 8 comprises a female connector shell 20, a jack insulating plate 21 and an electromagnet 22; the female connector shell 20 is fixedly arranged at the bottom of the housing 11 and communicated with the housing 11; the electromagnet 22 is arranged at the bottom of the jack insulating plate 21; the jack insulating plate 21 is fixedly arranged on the female connector shell 20; an annular groove 23 is arranged between the jack insulating plate 21 and the inner wall of the female connector shell 20; the bottom surface of the female connector shell 20 is a guide surface 24 inclined to the left; a right cylindrical surface of the female connector shell 20 is provided with a guide groove 25; the jack insulating plate 21 is internally provided with a jack 26 that is arranged vertically; a jack wire welding point 27 is fixedly arranged on the top of the jack 26; a conductive sleeve 28 is arranged in the jack 26 and is fixedly connected with one end of the jack wire welding point 27; the other end of the jack wire welding point 27 is connected with the cable 7;

a cable male connector 29 is also fixedly arranged in the water injection pipe string 1; the cable male connector 29 comprises a male connector shell 30, a pin insulating plate 31 and an NdFeB magnet 32; the NdFeB magnet 32 is a permanent magnet; the pin insulating plate 31 is fixedly arranged in the male connector shell 30; the NdFeB magnet 32 is arranged on the top of the pin insulating plate 31; a tapered surface 33 matched with the guide surface 24 is arranged in the middle of the male connector shell 30; a right cylindrical surface of the pin insulating plate 31 is provided with a guide bolt 34 matched with the guide groove 25; a pin 35 and a pin wire welding point 36 are arranged on the top and the bottom of the pin insulating plate 31 respectively; the pin wire welding point 36 is electrically connected with a sensor on the intelligent water distributor 4; a lead 37 which is positioned in the pin insulating plate 31 is connected between the pin 35 and the pin wire welding point 36.

A sealing ring I 38 is arranged on the top of the male connector shell 30; a cylindrical surface of the jack insulating plate 21 is provided with a sealing ring II 40; a snap spring 39 is fixedly arranged in the male connector shell 30; the pin insulating plate 31 is fixedly arranged on the snap spring 39. The sealing ring I 38 and the sealing ring II 40 can prevent short circuit and wet plug.

An automatic connection method for an oil pipe internal communication cable for intelligent layered water injection by using the device comprises the following steps:

S1, lowering the water injection pipe string 1 into an oil and gas well; lowering the cable 7 of the cable lowering mechanism into the water injection pipe string 1, such that all the rollers 12 are in contact with the inner wall of the water injection pipe string 1 respectively; then, injecting water to the water injection pipe string 1, wherein water flow provides power for downward movement of the cable lowering mechanism, that is, after the load-bearing blades 10 are impacted by water, the rollers 12 move downwards along the water injection pipe string 1; the wider the load-bearing blades 10, the faster the cable lowering speed, thereby accelerating the cable lowering speed;

S2, when the cable is lowered to a predetermined depth, i.e., the cable female connector 8 is about to touch the cable male connector 29, electrifying the electromagnet 22, wherein the cable male connector 8 and the cable male connector 29 attract with each other, the upper end of the male connector shell 30 is plugged into the annular groove 23 of the female connector shell 30, and the guide surface 24 on the bottom surface of the female connector shell 20 and the tapered surface 33 in the middle of the male connector shell 30 then gradually match to ensure the connection directionality; when the guide surface 24 completely matches the tapered surface 33, the guide bolt 34 is exactly plugged into the guide groove 25, and the pin 35 is plugged into the conductive sleeve 28, such that the docking between the cable female connector and the cable male connector is realized; the matching of the guide bolt 34 and the guide groove 25 can prevent the cable female connector and the cable male connector, which are connected, from axially shifting under the hydraulic impact, and the attraction between the electromagnet 22 and the NdFeB magnet 32 can prevent the cable female connector and the cable male connector, which are connected, from axially shifting under the hydraulic impact, thereby ensuring that the male connector and the female connector are connected more steadily;

S3, at the end of the step S2, controlling the motor 9 to rotate forward, wherein the motor 9 drives the screw rod 19 to rotate, and the nut 18 moves upwards along the screw rod 19, such that the lantern ring moves upwards; the connecting rod 16 drives the load-bearing blades 10 rotate around a hinge point between the load-bearing blades 10 and the housing 11 to converge the load-bearing blades 10; and S4, detecting a water injection flow rate, a water injection pressure and a temperature by a flow sensor 41, a pressure sensor 42 and a temperature sensor 43 on the intelligent water distributor 4 respectively, and converting these parameters into electric signals, wherein the electric signals are finally transmitted to ground monitoring or control equipment via the pin wire welding point 36, the lead 37, the pin 35, the conductive sleeve 28, the jack wire welding point 27 and the cable 7 in sequence, thereby realizing ground and downhole real-time communication, and further realizing the control over the water injection pressure and the water injection flow rate.

The foregoing description is only preferred embodiments of the present invention, and it should be understood that the present invention is not limited to the forms disclosed herein, and should not be taken as excluding other embodiments, but may be used in various other combinations, modifications, and environments, and can be amended within the concept described herein in accordance with the teachings above or techniques or knowledge in the related art. Modifications and changes made by those skilled in the art without departing from the spirit and scope of the present invention shall fall within the protection scope of the appended claims of the present invention.

We claim:

1. A downhole automatic connection device for an oil pipe internal communication cable for intelligent layered water injection, comprising a water injection pipe string, and a hydraulic anchor, a cable-through packer, an intelligent water distributor, a hydraulic support anchor and a plug, the hydraulic anchor, the cable-through packer, the intelligent water distributor, the hydraulic support anchor and the plug are sequentially connected to a lower end of the water injection pipe string, wherein a cable lowering mechanism is arranged in the water injection pipe string; the cable lowering mechanism comprises a cable, a cable female connector, a motor and a plurality of load-bearing blades; a tail end of the cable is sleeved with a housing; the plurality of load-bearing blades are uniformly hinged on a cylindrical surface of the housing in a circumferential direction of the cylindrical surface; a roller is rotatably mounted at an end of each of the plurality of load-bearing blades; each roller is tangential to an inner wall of the water injection pipe string; a through groove which is positioned above each of the plurality of load-bearing blades is arranged on each of two sides of the housing; the housing is sleeved with a left semicircular member and a right semicircular member, the left semicircular member and the right semicircular member are fixedly connected; a first connecting rod is hinged on each of the left semicircular member and the right semicircular member; an end of each of the first connecting rods is hinged on each of the plurality of load-bearing blades; two second connecting rods penetrating through the corresponding through groove are respectively fixedly arranged on the left semicircular member and the right semicircular member respectively; a nut is fixed between the two second connecting rods; the motor is fixedly arranged in the housing; a screw rod is connected to an output shaft of the motor and is in a threaded connection with the nut; the cable female connector comprises a female connector shell, a jack insulating plate and an electromagnet; the female connector shell is fixedly arranged at a bottom of the housing and communicated with the housing; the electromagnet is arranged at a bottom of the jack insulating plate; the jack insulating plate is fixedly arranged on the female connector shell; an annular groove is arranged between the jack insulating plate and an inner wall of the female connector shell; a bottom surface of the female connector shell is a guide surface inclined to left; a right cylindrical surface of the female connector shell is provided with a guide groove; the jack insulating plate is internally provided with a jack that is arranged vertically; a jack wire welding point is fixedly arranged on a top of the jack; a conductive sleeve is arranged in the jack and is fixedly connected with a first end of the jack wire welding point; a second end of the jack wire welding point is connected with the cable; a cable male connector is fixedly arranged in the water injection pipe string; the cable male connector comprises a male connector shell, a pin insulating plate and an NdFeB magnet; the pin insulating plate is fixedly arranged in the male connector shell; the NdFeB magnet is arranged on a top of the pin insulating plate; a tapered surface matched with the guide surface is arranged in a middle of the male connector shell; a right cylindrical surface of the pin insulating plate is provided with a guide bolt matched with the guide groove; a pin and a pin wire welding point are arranged on a top and a bottom of the pin insulating plate respectively; the pin wire welding point is electrically connected with a sensor on the intelligent water distributor; a lead which is positioned in the pin insulating plate is connected between the pin and the pin wire welding point, the cable female connector is mounted at a head of the cable, when the cable is lowered to a depth the cable female connector and the cable male connector are docked.

2. The downhole automatic connection device for the oil pipe internal communication cable for intelligent layered water injection according to claim 1, wherein a first sealing ring is arranged on a top of the male connector shell.

3. The downhole automatic connection device for the oil pipe internal communication cable for intelligent layered water injection according to claim 1, wherein a snap spring is fixedly arranged in the male connector shell.

4. The downhole automatic connection device for the oil pipe internal communication cable for intelligent layered water injection according to claim 1, wherein the pin insulating plate is fixedly arranged on a snap spring.

5. The downhole automatic connection device for the oil pipe internal communication cable for intelligent layered water injection according to claim 1, wherein a cylindrical surface of the jack insulating plate is provided with a second sealing ring.

6. The downhole automatic connection device for the oil pipe internal communication cable for intelligent layered water injection according to claim 1, wherein a communication cable, a control cable and a power cable are arranged in the cable.

7. The downhole automatic connection device for the oil pipe internal communication cable for intelligent layered water injection according to claim 1, wherein the NdFeB magnet is a permanent magnet.

8. A downhole automatic connection method of operation for an oil pipe internal communication cable for intelligent layered water injection by using the device according to claim 1, comprising following steps:

S1, lowering the water injection pipe string into an oil and gas well; lowering the cable of the cable lowering mechanism into the water injection pipe string, such that all the rollers are in contact with the inner wall of the water injection pipe string respectively; then, injecting water to the water injection pipe string, wherein water flow provides power for downward movement of the cable lowering mechanism, that is, after the load-bearing blades are impacted by water, the rollers move downwards along the water injection pipe string;

S2, when the cable is lowered to a predetermined depth, the cable female connector is about to touch the cable male connector, electrifying the electromagnet wherein the cable female connector and the cable male connector attract with each other, an upper end of the male connector shell is plugged into the annular groove of the female connector shell, and the guide surface on the bottom surface of the female connector shell and the tapered surface in the middle of the male connector shell then gradually match to ensure a connection directionality; after the guide surface completely matches the tapered surface, the guide bolt is exactly plugged into the guide groove, and the pin is plugged into the conductive sleeve, such that a docking between the cable female connector and the cable male connector is realized;

S3, at the end of the step S2, controlling the motor to rotate forward, wherein the motor drives the screw rod to rotate, and the nut moves upwards along the screw rod, such that a lantern ring moves upwards; each of the first connecting rods drives the load-bearing blades to rotate around a hinge point between the load-bearing blades and the housing to converge the load-bearing blades; and S4, detecting a water injection flow rate, a water injection pressure and a temperature by a flow sensor, a pressure sensor and a temperature sensor on the intelligent water distributor respectively, and converting these parameters into electric signals, wherein the electric signals are finally transmitted to ground monitoring or control equipment via the pin wire welding point, the lead, the pin, the conductive sleeve, the jack wire welding point and the cable in sequence.

9. The downhole automatic connection method of operation for the oil pipe internal communication cable for intelligent layered water injection according to claim 8, wherein a first sealing ring is arranged on a top of the male connector shell.

10. The downhole automatic connection method of operation for the oil pipe internal communication cable for intelligent layered water injection according to claim 8, wherein a snap spring is fixedly arranged in the male connector shell.

11. The downhole automatic connection method of operation for the oil pipe internal communication cable for intelligent layered water injection according to claim 8, wherein the pin insulating plate is fixedly arranged on a snap spring.

12. The downhole automatic connection method of operation for the oil pipe internal communication cable for intelligent layered water injection according to claim 8, wherein a cylindrical surface of the jack insulating plate is provided with a second sealing ring.

13. The downhole automatic connection method of operation for the oil pipe internal communication cable for intelligent layered water injection according to claim 8, wherein a communication cable, a control cable and a power cable are arranged in the cable.

14. The downhole automatic connection method of operation for the oil pipe internal communication cable for intelligent layered water injection according to claim 8, wherein the NdFeB magnet is a permanent magnet.

* * * * *